US011484455B2

(12) United States Patent
di Girolamo

(10) Patent No.: US 11,484,455 B2
(45) Date of Patent: Nov. 1, 2022

(54) MULTIPLACE HYPERBARIC CHAMBER SYSTEMS AND METHODS

(71) Applicant: Edward R. di Girolamo, Raleigh, NC (US)

(72) Inventor: Edward R. di Girolamo, Raleigh, NC (US)

(73) Assignee: Extivita, LLC, Raleigh, NC (US)

( * ) Notice: Subject to any disclaimer, the term of this patent is extended or adjusted under 35 U.S.C. 154(b) by 1599 days.

(21) Appl. No.: 14/966,565

(22) Filed: Dec. 11, 2015

(65) Prior Publication Data

US 2016/0206492 A1 Jul. 21, 2016

Related U.S. Application Data

(60) Provisional application No. 62/090,620, filed on Dec. 11, 2014.

(51) Int. Cl.
*A61G 10/02* (2006.01)

(52) U.S. Cl.
CPC ..... *A61G 10/026* (2013.01)

(58) Field of Classification Search
CPC .... A61G 10/026; A61G 10/023; A61G 10/02; A61G 2203/34; A61G 10/04; A61G 10/005; A61G 11/00; A61G 10/00; A61M 21/0094; B63C 11/325; A61H 2033/143; A61H 33/14; A61H 33/066; A61H 33/6005; A62B 31/00; A62B 7/02; A63B 2208/053; F24F 13/0209; E04H 1/12; E04H 3/08
See application file for complete search history.

(56) References Cited

U.S. PATENT DOCUMENTS 3,074,123 A * 1/1963 Gartrell ..... E04B 1/948 52/586.2
3,868,297 A 2/1975 Jamison et al.
4,078,348 A * 3/1978 Rothman ..... E04C 2/205 52/192

(Continued)

FOREIGN PATENT DOCUMENTS

AU 2015360350 8/2020
EP 3229748 A1 8/2019

(Continued)

OTHER PUBLICATIONS

Communication of Extended European search report corresponding to European Application No. 15867033.1 dated Jun. 18, 2018.

(Continued)

*Primary Examiner* — Victoria Murphy
(74) *Attorney, Agent, or Firm* — Jenkins, Wilson, Taylor & Hunt, P.A.

(57) ABSTRACT

The present subject matter relates to devices, systems and methods for the construction of pressure chambers. Such pressure chamber devices, systems, and methods can include a plurality of substantially rigid panels arranged around a space, each of the substantially rigid panels comprising a metal frame formed from a plurality of metal frame elements. One or more connecting plate can be coupled to adjacent pairs of the plurality of substantially rigid panels. In this way, the one or more connecting plate is configured to provide a pressure-tight seal between a respective adjacent pair of the plurality of substantially rigid panels.

24 Claims, 13 Drawing Sheets

(56) References Cited

U.S. PATENT DOCUMENTS

| | | | | |
|---|---|---|---|---|
| 4,694,736 | A | 9/1987 | Yamagata et al. | |
| 5,152,814 | A | 10/1992 | Nelson | |
| 5,975,081 | A | 11/1999 | Hood et al. | |
| 6,347,628 | B1 * | 2/2002 | Maison | A61G 10/026 128/201.27 |
| 6,354,457 | B1 * | 3/2002 | Aaron | F17C 1/00 220/581 |
| 8,375,938 | B2 * | 2/2013 | Gaumond | A61G 10/026 128/202.12 |
| 2006/0266293 | A1 | 11/2006 | Fink et al. | |
| 2008/0210239 | A1 | 9/2008 | Lewis | |
| 2012/0060443 | A1 | 3/2012 | Vernon et al. | |
| 2013/0062852 | A1 * | 3/2013 | Dodd | B60G 7/02 280/124.117 |

FOREIGN PATENT DOCUMENTS

| | | | |
|---|---|---|---|
| FR | 2 660 548 | A1 | 10/1991 |
| JP | 2011234837 | A | 11/2011 |

OTHER PUBLICATIONS

International Preliminary Report on Patentability corresponding to International Application No. PCT/US2015/065269 dated Jun. 13, 2017.

Decision to Grant corresponding to European Application No. 15867033.1 dated Aug. 1, 2019.

Examiner's Report corresponding to Australian Patent Application No. 2015360350 dated Aug. 23, 2019.

Intention to Grant corresponding to European Application No. 15867033.1 dated Mar. 18, 2019.

Communication of European publication number and information on the application of Article 67(3) EPC corresponding to corresponding to International Application No. 15867033.1 dated Sep. 20, 2017.

Notification of Transmittal of the International Search Report and the Written Opinion of the International Searching Authority corresponding to International Application No. PCT/US15/65269 dated Feb. 4, 2016.

Notice of Acceptance corresponding to Australian Patent Application No. 2015360350 dated Apr. 28, 2020.

Office Action corresponding to Canadian Patent Application No. 2970498 dated Nov. 19, 2021.

* cited by examiner

MULTIPLACE HYPERBARIC CHAMBER SYSTEMS AND METHODS

PRIORITY CLAIM

The present application claims the benefit of U.S. Patent Application Ser. No. 62/090,620, filed Dec. 11, 2014, the disclosure of which is incorporated herein by reference in its entirety.

TECHNICAL FIELD

The subject matter disclosed herein relates generally to pressure chambers. More particularly, the subject matter disclosed herein relates to hyperbaric or hypobaric chambers configured to artificially reproduce pressures different than normal atmospheric pressure.

BACKGROUND

Hyperbaric medicine, also known as hyperbaric oxygen therapy (HBOT), is the medical use of oxygen at a level higher than atmospheric pressure (e.g., at 1½ to 3 times normal atmospheric pressure). The equipment required typically includes a pressure chamber, which may be of rigid or flexible construction, and a system for delivering 100% oxygen. Operation is performed to a predetermined schedule by trained personnel who monitor the patient and can adjust the schedule as required. HBOT has found early use in the treatment of decompression sickness, and it has also shown effectiveness in treating conditions such as gas gangrene and carbon monoxide poisoning. More recent research has examined the possibility that it may also have value for other conditions such as arterial gas embolism, necrotic soft tissue infections, crushing injuries, traumatic brain injuries, cerebral palsy, and multiple sclerosis, among others.

HBOT is usually delivered in monoplace chambers, which are generally only big enough for a single patient. A few hospitals and specialized centers around the world have multiplace chambers, which are big enough for several patients and/or an attendant. All existing chamber designs exhibit significant drawbacks, however, including high cost and limited interior space (even in multiplace chambers). As a result, the cost and availability of such systems are prohibitive for many individuals who may benefit from hyperbaric therapy.

Accordingly, it would be desirable to provide hyperbaric chamber systems that can be produced in a more cost-effective manner while still being able to effectively provide the atmospheric conditions recommended for hyperbaric therapies.

SUMMARY

In accordance with this disclosure, devices, systems and methods for the construction of pressure chambers are provided. In one aspect, a pressure chamber system is provided in which a plurality of substantially rigid panels are arranged around a space, each of the substantially rigid panels comprising a metal frame formed from a plurality of metal frame elements. One or more connecting plate is coupled to adjacent pairs of the plurality of substantially rigid panels, and a pressure differential generator is configured to control pressure within the space to be different than an atmospheric pressure outside of the space. In such a system, the one or more connecting plate is configured to provide a pressure-tight seal between a respective adjacent pair of the plurality of substantially rigid panels.

In another aspect, an assembly of substantially rigid panels for a pressure chamber system comprises a plurality of substantially rigid panels arranged around a space, each of the substantially rigid panels comprising a plurality of elongated beam elements formed from a plurality of metal frame elements, and one or more connecting plate coupled to adjacent pairs of the plurality of substantially rigid panels. The one or more connecting plate is configured to provide a pressure-tight seal between a respective adjacent pair of the plurality of substantially rigid panels.

In yet another aspect, a method for constructing a pressure chamber is provided. The method can comprise forming a plurality of substantially rigid panels, each of the substantially rigid panels comprising a metal frame formed from a plurality of metal frame elements, arranging the a plurality of substantially rigid panels around a space, coupling adjacent pairs of the plurality of substantially rigid panels using one or more connecting plate, wherein the one or more connecting plate is configured to provide a pressure-tight seal between a respective adjacent pair of the plurality of substantially rigid panels, and connecting a pressure differential generator in communication with the space to control pressure within the space to be different than an atmospheric pressure outside of the space.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides systems, devices, and methods for pressure chambers (e.g., hyperbaric or hypobaric chambers) configured to artificially reproduce pressures different than normal atmospheric pressure. In one aspect, for example, the present subject matter provides a large pressure chamber constructed using a modular assembly of substantially rigid panels (e.g., light-gauge steel frame panels). Particularly, the pressure chamber can comprise a plurality of substantially rigid panels coupled together in a substantially pressure-tight arrangement around a space.

In one non-limiting configuration illustrated in FIGS. 1-8, the substantially rigid panels include a metal frame. As shown in FIGS. 1-4, for example, substantially rigid panels, generally designated 100, can be formed from one or more substantially rigid structural elements. In particular, as shown in FIGS. 2-5, the structural elements can comprise elongated beam elements 110 that are formed from one or more metal frame elements 120. In some embodiments, for example, metal frame elements 120 can comprise steel elements (e.g., roll-formed steel elements) similar to those used in light steel framing applications. In this regard, metal frame elements 120 can comprise light gauge steel elements (e.g., having thicknesses less than 0.125 inches). Specifically, in some particular embodiments, metal frame elements 120 can have thicknesses between about 0.030 inches and 0.125 inches, with some configurations providing a desirable balance of weight, structural integrity, and strength (e.g., 50 ksi minimum yield strength) with thicknesses less than 0.075 inches).

Figure 6:
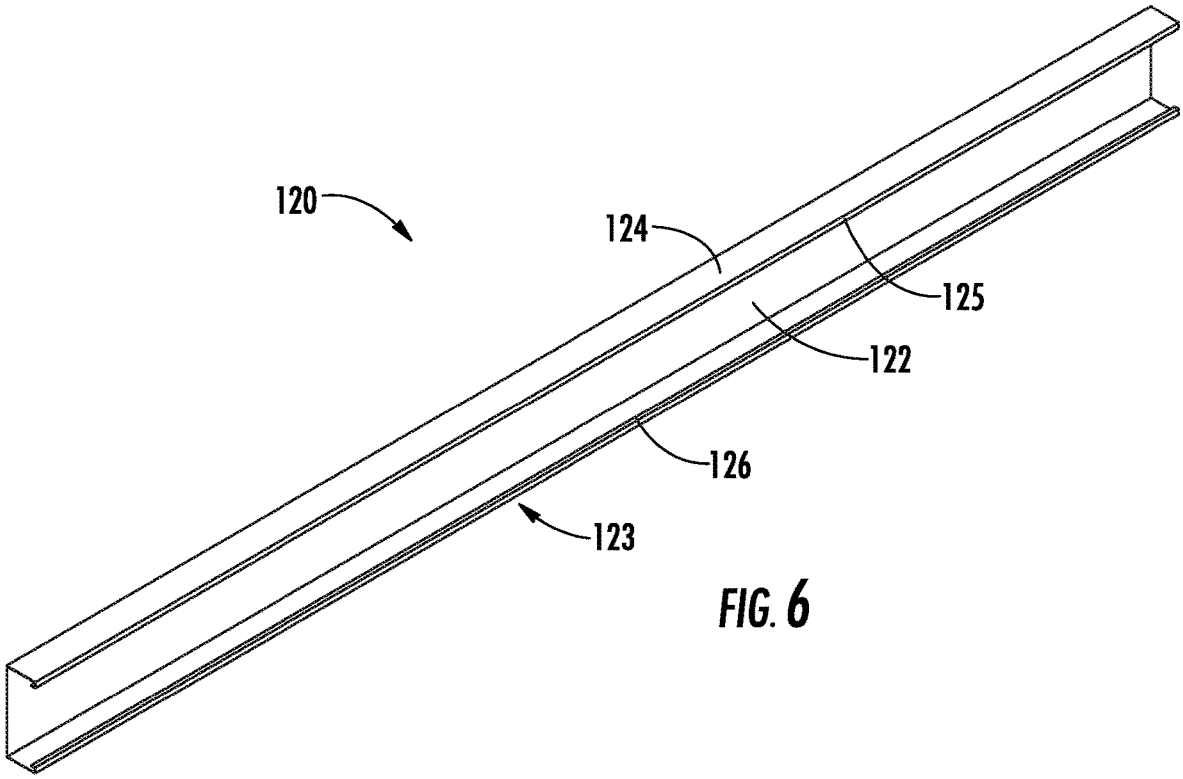
FIGS. 6 and 7 are perspective side views of metal frame elements for use as a component of a substantially rigid panel in a pressure chamber according to embodiments of the presently disclosed subject matter.
Figure 7:
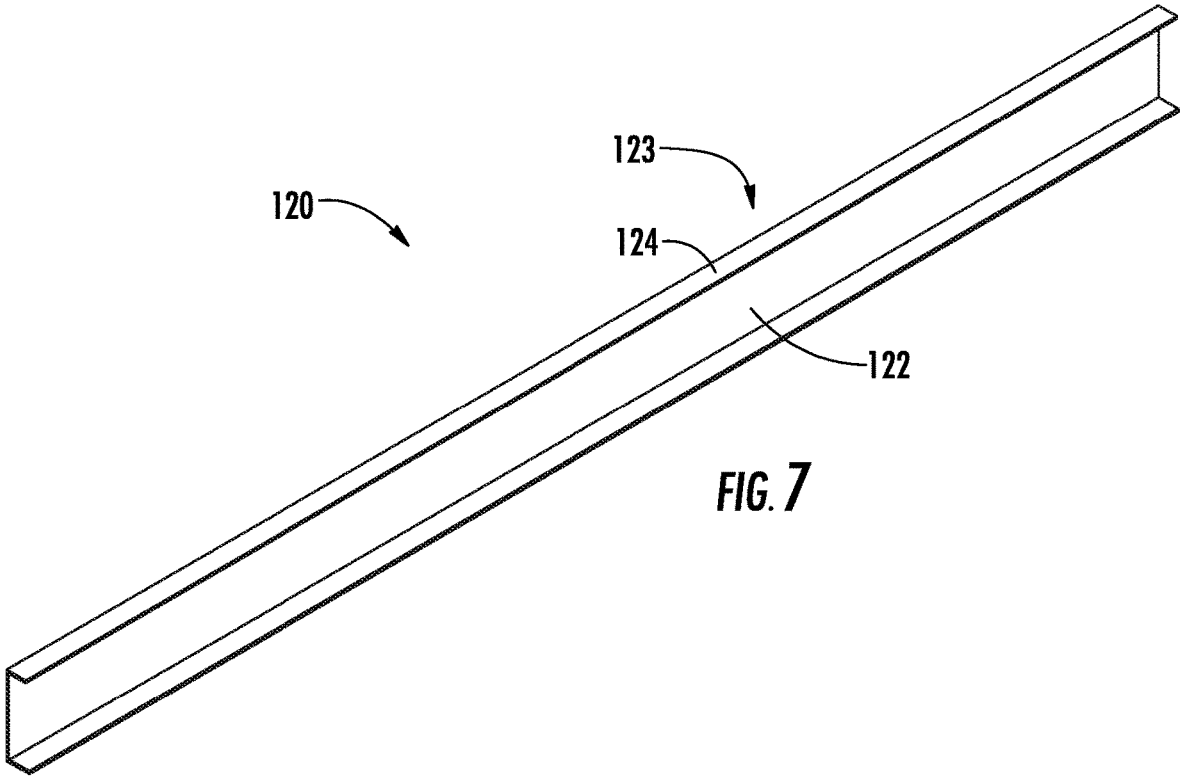

In some exemplary embodiments shown in FIGS. 6 and 7, frame elements 120 can have any of a variety of cross-sectional configurations that can be selected based on a balance of factors. Specifically, FIG. 6 illustrates on exemplary configuration in which each of frame elements 120 has a substantially C-shaped cross-sectional profile including a web 122 (e.g., about 10 inches wide) and a pair of flanges 123 that each extend from opposing sides of web 122 in a direction substantially perpendicular to the plane of web 122 and are substantially parallel to one another. Further, in the embodiment shown in FIG. 6, each of flanges 123 has a substantially J-shaped profile that includes a side 124, a lip 125 extending inwardly from side 124 (i.e., from an end of side 124 substantially opposite from the end to which side 124 connected to web 122) in a direction substantially parallel to web 122, and a turned end 126 extending from lip 125 in a direction substantially parallel to side 124. This arrangement can provide enhanced resistance to bending and/or buckling. In this regard, frame elements 120 can be configured to contribute to improved strength and rigidity of substantially rigid panels 110 to allow the pressure chamber to bear the expected loads encountered under operating pressures, which can be comparatively extreme compared to conventional structural loads. Alternatively, FIG. 7 illustrates a further configuration in which flange 123 only includes two sides 124. This configuration can be generally less resistant to bending but can be more readily manufactured. Thus, the particular configuration for the individual frame elements 120 can be selected to address the design considerations for a given system.

Figure 1:
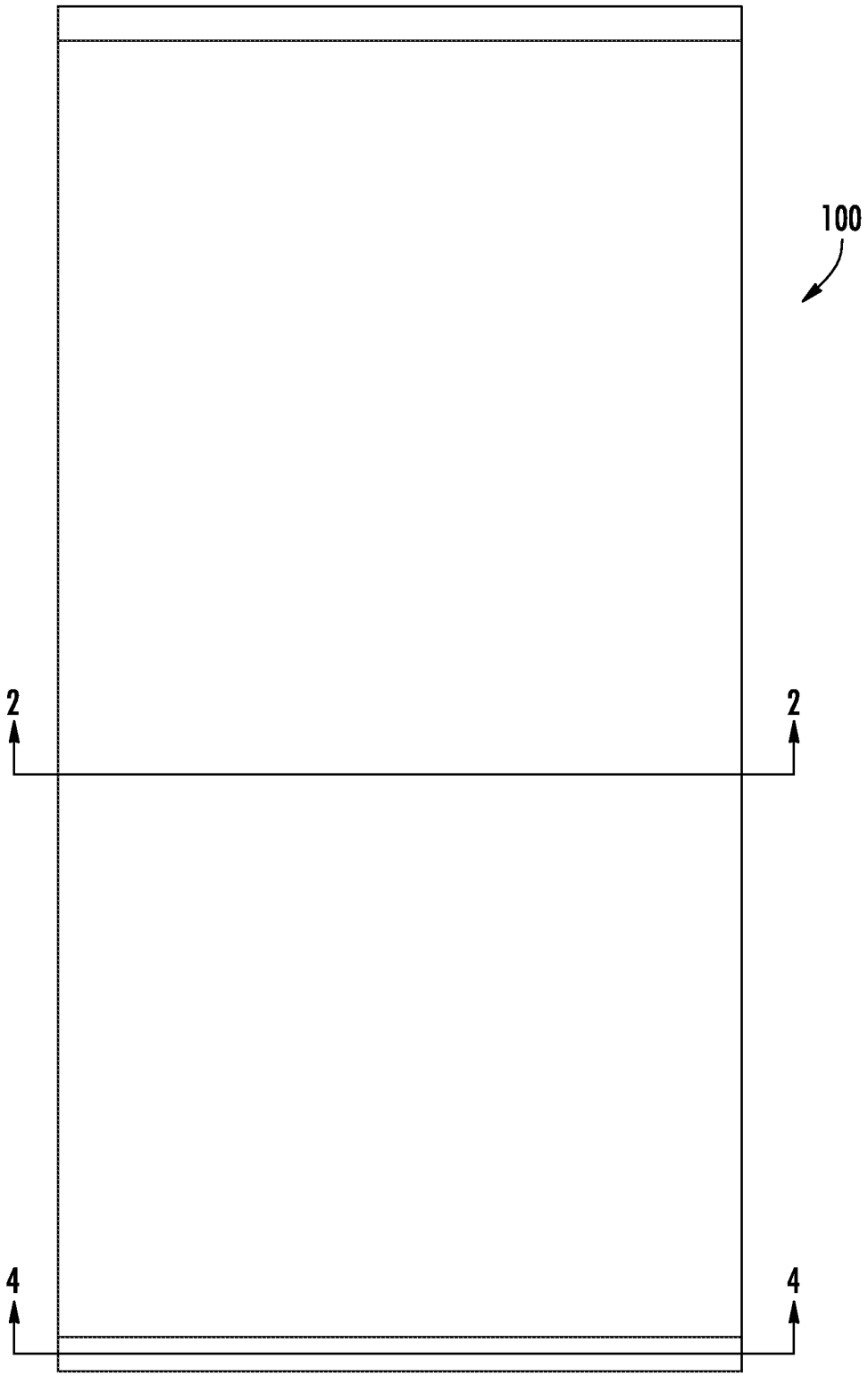
FIG. 1 is a top view of a substantially rigid panel for use as a structural element in a pressure chamber according to an embodiment of the presently disclosed subject matter.
Figure 2:
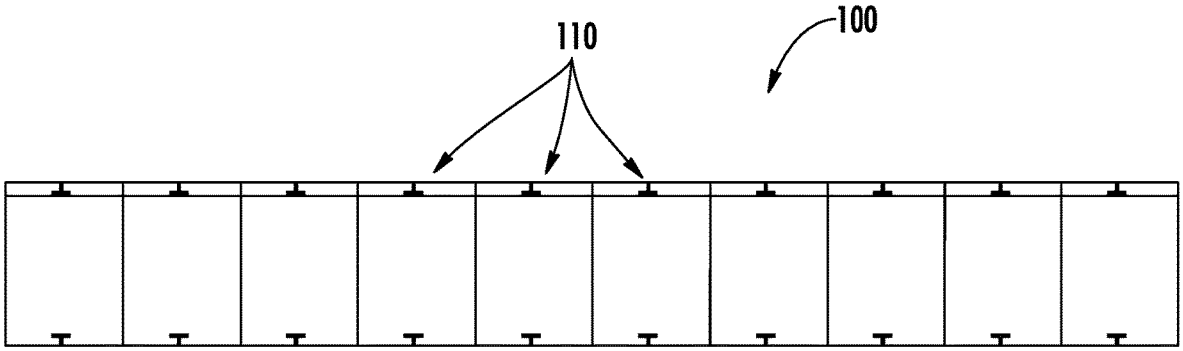
FIG. 2 is a sectional side view of a substantially rigid panel for use as a structural element in a pressure chamber taken along section line 2-2 of FIG. 1.
Figure 3:
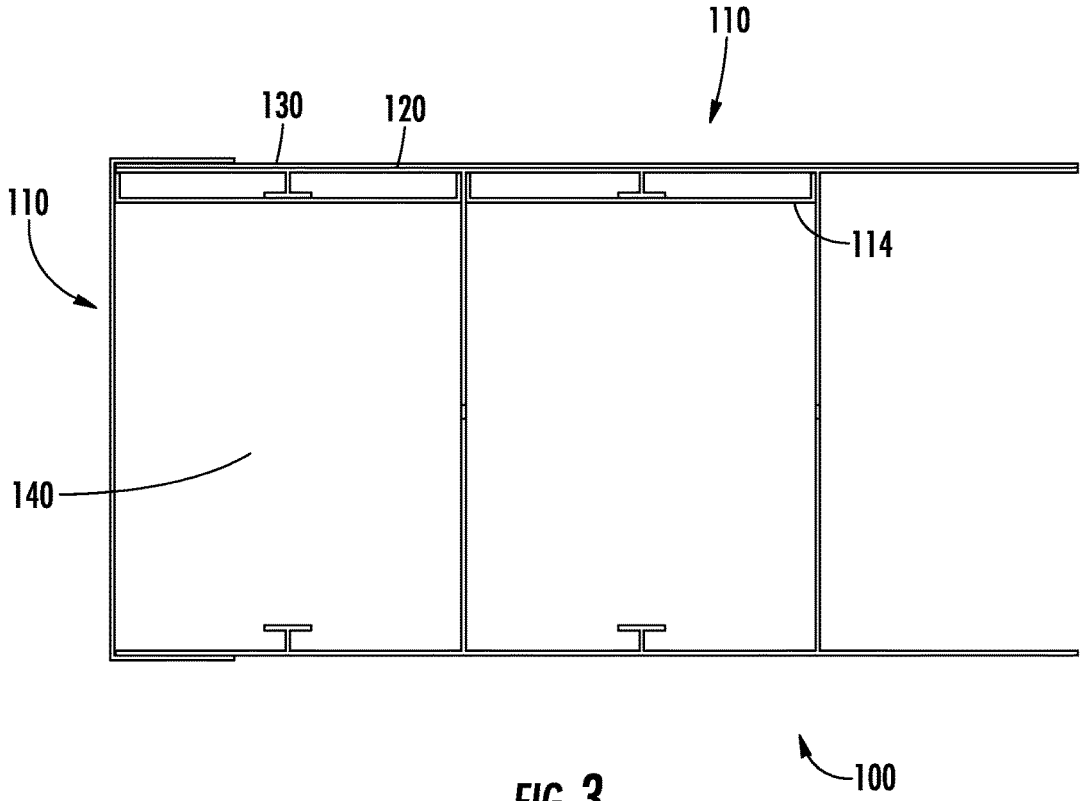
FIG. 3 is a detailed side view of the substantially rigid panel shown in FIG. 2.
Figure 4:
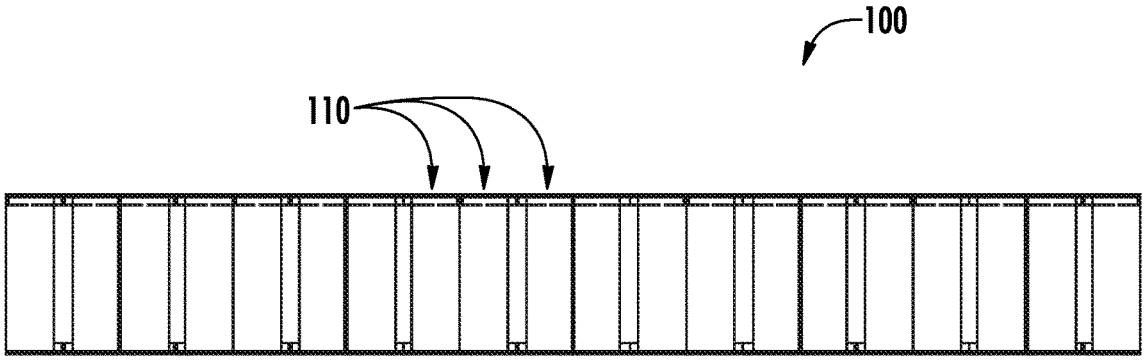
FIG. 4 is a sectional side view of a substantially rigid panel for use as a structural element in a pressure chamber taken along section line 4-4 of FIG. 1.
Figure 5:
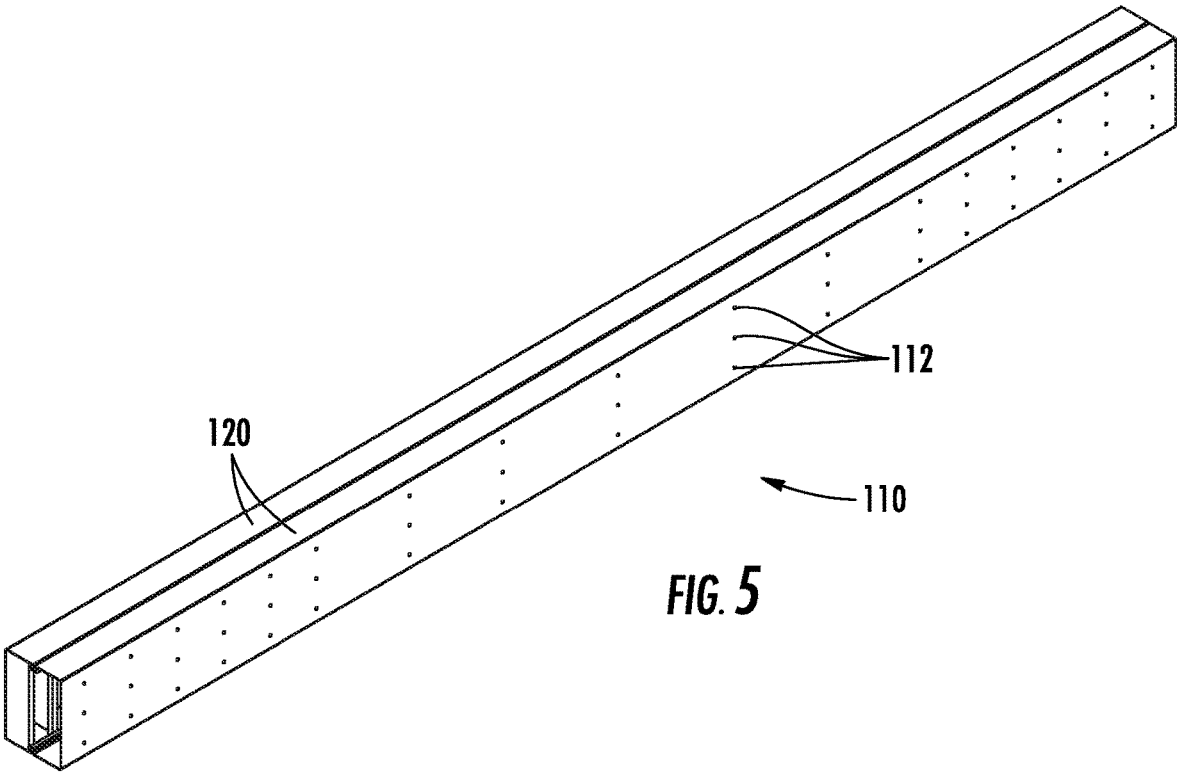
FIG. 5 is a perspective side view of a beam element for use as a component of a substantially rigid panel in a pressure chamber according to an embodiment of the presently disclosed subject matter.
Figure 8:
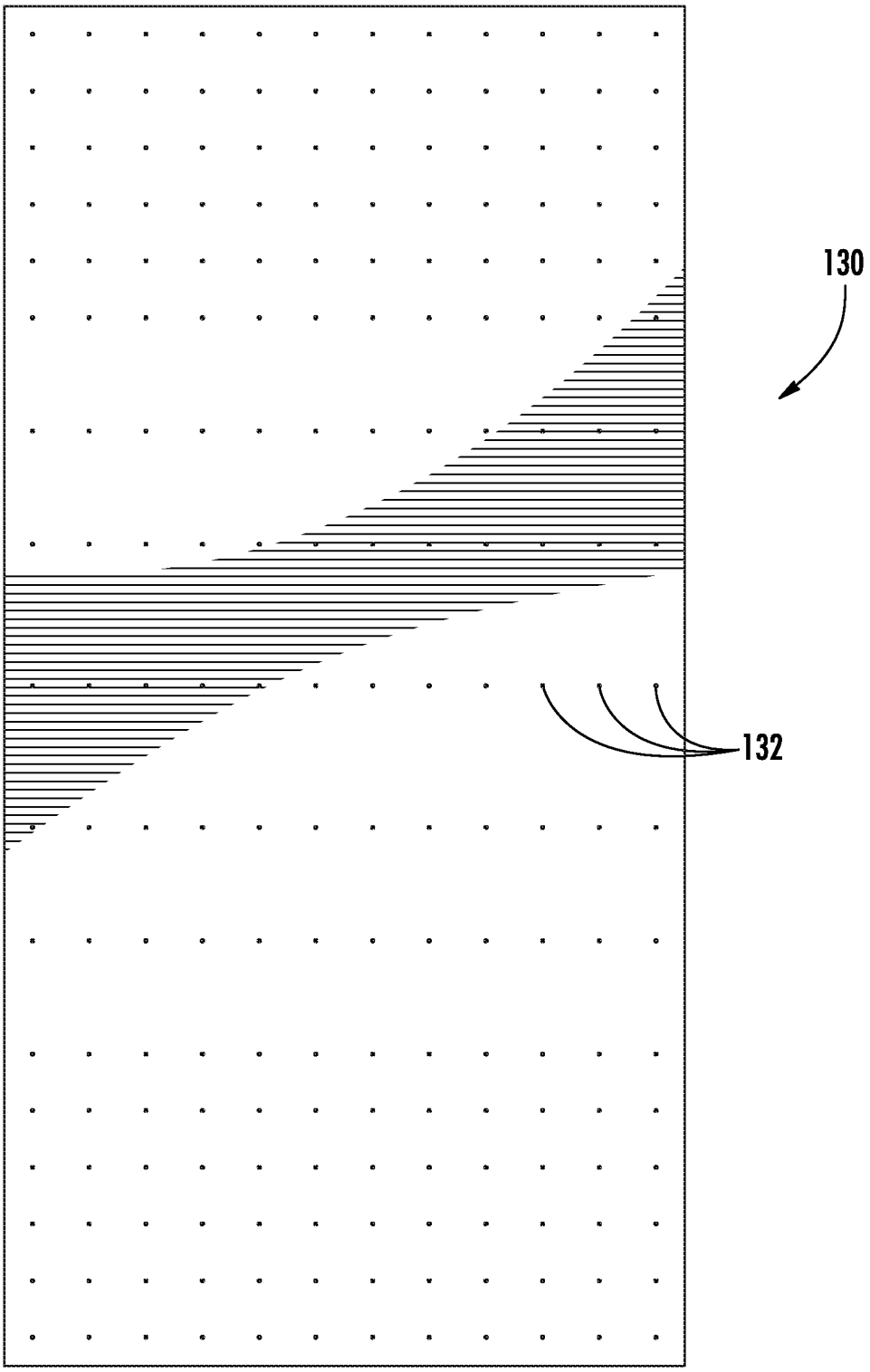
FIG. 8 is a top view of a sheet element for use as a component of a substantially rigid panel in a pressure chamber according to an embodiment of the presently disclosed subject matter.

Regardless of their particular form, frame elements 120 can be coupled together to define beam elements 110. In the embodiments shown in FIGS. 2-5, for example, a pair of frame elements 120 is joined at their flanges 123 (e.g., for the configuration shown and described with respect to FIG. 6, two frame elements 120 can be joined by coupling their respective lips 125 together). A plurality of beam elements 110 can then be coupled together to define panels 100. (See, e.g., FIGS. 1-4, where an array of beam elements 110 are coupled together to define a panel 100 having dimensions of about 6 feet wide by 12 feet tall)) As illustrated in FIGS. 2-4, for example, adjacent pairs of beam elements 110 can be coupled together at their respective webs 122 in a back-to-back configuration. Alternatively, those having skill in the art will recognize that beam elements 110 can be coupled to one another in other arrangements to form panels 100. (e.g., a web 122 of one of beam elements 110 connected to flanges 123 of an adjacent one of beam elements 110) As shown in FIG. 8, in some embodiments, beam elements 110 can be further coupled by planar sheet elements 130 (e.g., 0.054 inch sheet steel), which can be arranged across the stacked array of beam elements 110.

In some embodiments, beam elements 110 are coupled to one another and/or to planar sheet elements 130 by fasteners (e.g., blind self-sealing rivets) at a variety of beam connection points 112 in a manner substantially similar to the construction of aircraft. Sheet elements 130 can likewise be connected to beam elements 110 by fasteners at sheet connection points 132 (see FIG. 8), which can in some embodiments correspond to beam connection points 112. Alternatively, any of a variety of other known connection mechanisms (e.g., spot welding) can be used to create panels 100. In some particular configurations, beam and sheet connection points 112 and 132 at which beam elements 110 are connected are arranged in an optimized pattern (See, e.g., FIGS. 5 and 8), which can distribute load over the connected surfaces, minimize stresses at the connection points 112 and 132, and/or otherwise improve the structural performance of panels 100.

Furthermore, additional strengthening can be added to the tension-side of each of beam elements 110 by inserting a cap track 114 (e.g., having a thickness of about 0.043 inch) within one or more of beam elements 110 against the inner surface of one (or both) of flanges 123 of each substantially C-shaped frame element 120 as shown in FIGS. 2-4. In some embodiments, to further reinforce the strength and rigidity of panels 100, beam elements 110 can be filled with a core material 140, such as a polymer core material (e.g., polyurethane fill). In some embodiments, for example, core material 140 can be selected to further provide for added thermal resistance and/or to help decrease sound transmission.

Figure 9:
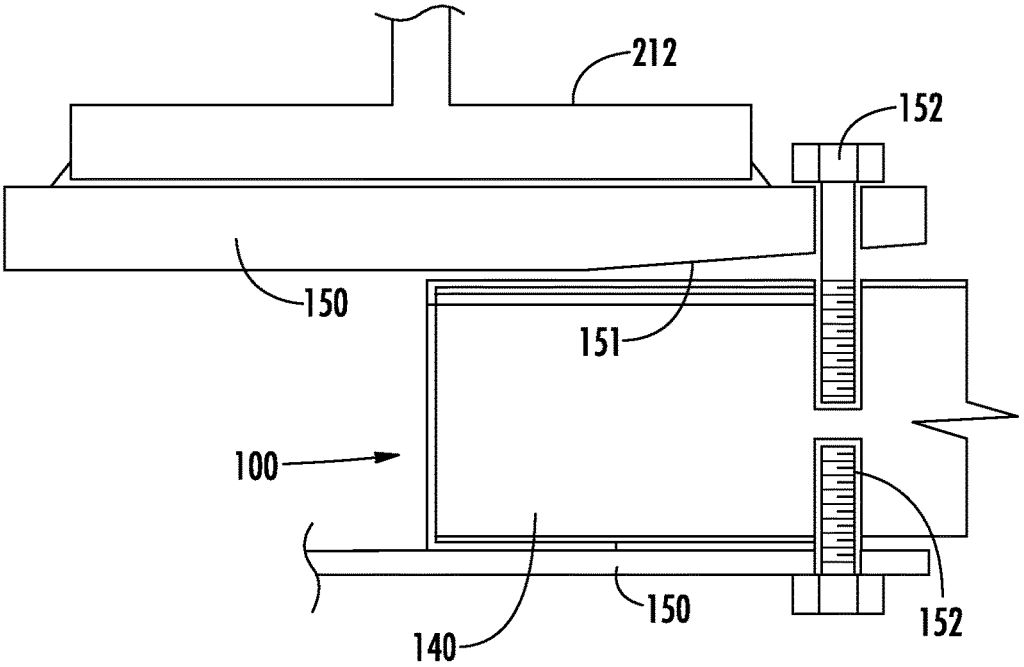
FIGS. 9 and 10 are side cutaway views of connection plate assemblies for use in joining substantially rigid panels in a pressure chamber according to embodiments of the presently disclosed subject matter.
Figure 10:
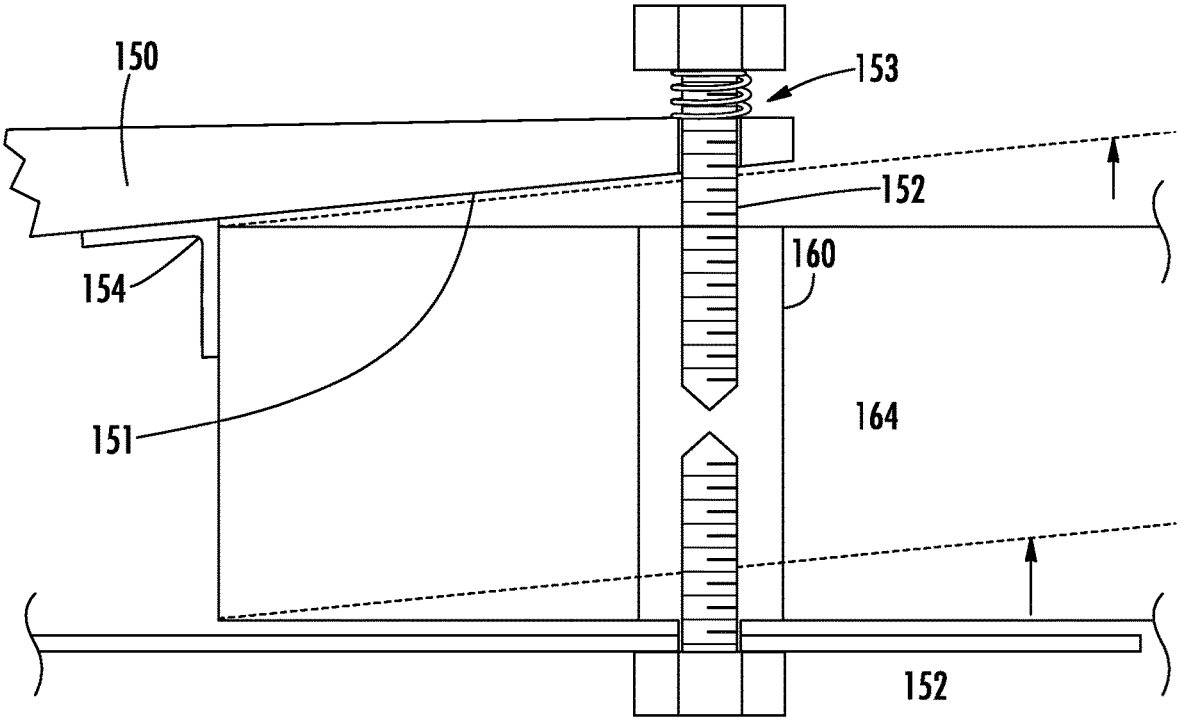

Regardless of the particular configuration, multiple panels 100 can be coupled together to define a pressure chamber 200 as discussed above. In this regard, the interconnection of panels 100 can include one or more features configured to maintain a pressure seal between panels 100. Specifically, for example, as illustrated in FIGS. 9 and 10, one or more connecting plate 150 can be configured to provide a substantially pressure-tight seal between a respective adjacent pair of panels 100. In particular, a first connecting plate 150 can be coupled to a first surface of a respective adjacent pair of the plurality of panels 100, and a second connecting plate 150 can be coupled to a second surface of a respective adjacent pair of panels 100 substantially opposing the first surface.

One or more connecting fastener 152 (e.g., a bolt or screw) can be used to connect connecting plates 150 to panels 100. In some embodiments, connecting fastener 152 can include a biasing member 153 (e.g., a spring) configured to exert a force that tends to draw connecting plate 150 and connected panel 100 together. In this way, connecting fastener 152 can be kept in a state of tension that helps to maintain the coupling between connecting plate 150 and panels 100.

In some embodiments, each connecting fastener 152 can be received by a corresponding coupling block 160 that is formed in, attached to, or otherwise connected with a respective one of panels 100. For example, in some embodiments, coupling block 160 can be molded into core material 140. In any configuration, coupling block 160 enables coupling between connecting fastener 152 to panels 100 without introducing a gap or opening in panels 100 that could allow pressure to leak across panels 100. In one particular embodiment shown in FIG. 11, for example, coupling block 160 can comprise one or more opening 162 configured to receive a corresponding connecting fastener 152 (e.g., a threaded opening where connecting fastener 152 comprises a complementarily threaded bolt).

Figure 11:
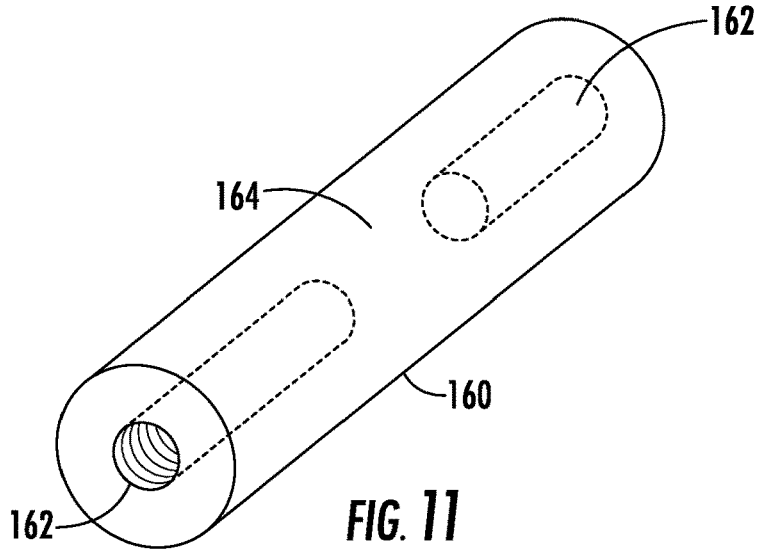
FIG. 11 is a side perspective view of a coupling block for use in joining substantially rigid panels in a pressure chamber according to embodiments of the presently disclosed subject matter.

Furthermore, as in the embodiment shown in FIGS. 10 and 11, coupling block 160 can be configured to extend substantially an entire distance through panel 100 for coupling with connecting fasteners 152 on either side of panels 100. In such an arrangement, coupling block 160 can be configured such that each opening 162 terminates within coupling block 160 such that there is no communication between opposing openings 162. In this regard, a substantially pressure-tight barrier 164 can be provided within coupling block 160 between openings 162 to help maintain the pressure differential between the inside and outside surfaces of panels 100. Alternatively, an individual coupling block 160 can be associated with each connecting fastener 152.

In addition, in some configurations, panels 100 can be expected to deflect in response to a pressure differential between the interior and exterior of pressure chamber 200. For example, in arrangements in which panels 100 are sized to span large distances (e.g., 6-12 feet in width), which can help to limit the number of panels 100 needed to define pressure chamber 200 and accordingly limit the number of inter-panel connections that need to be sealed, panels 100 can deflect two inches or more for every six feet of unbounded span. Where panels 100 and connecting plates 150 are assembled to seal against one another in an unpressurized state, such a deflection can change the relative orientation of the components and open a gap therebetween.

In this regard, in some embodiments, one or both of the plurality of panels 100 or the one or more connecting plate 150 can be shaped to maintain a sealing relationship between the respective substantially rigid panels and connecting plate upon deflection of the substantially rigid panels under pressurization of the space. Specifically, to accommodate such deflection, in the exemplary configurations shown in FIGS. 9 and 10, connecting plate 150 can be tapered at one or more of its edges 151 such that connecting plate 150 lies substantially flush with coupled ends of the adjacent pairs of the plurality of panels 100 upon deflection of panels 100. (e.g., in the orientation shown in FIGS. 9 and 10, pressurization of the structure can result in a center portion of panels 100 deflecting upwards) In this way, the shape of one or more connecting plate 150 can be designed such that when the structure is pressurized to its full operating load, connecting plate 150 can mate completely with the deflected shape of panels 100.

Furthermore, in conditions that differ from the fully-loaded operating condition, the seal along the bearing edge (i.e., at an interface between connecting plate 150 and one of panels 100) can act as a pivot point and will not open up with the tapered bearing surface, even upon fluctuations of the pressure differential that result in deflections of panels 100 (e.g., the structure can be configured to be loaded to a variety of pressures throughout the day). To further maintain the seal between panels 100, a flexible sealing element 154 can be used to maintain a sealing relationship between panels 100 and connecting plate 150. Referring again to the exemplary configuration shown in FIG. 10, sealing element 154 can comprise an elastomeric element (e.g., a rubber seal) positioned between the one or more connecting plate 150 and each of the respective adjacent pair of the plurality of panels 100. Alternatively, sealing element 154 can be any of a variety of other forms of flexible sealants known to those having skill in the art. In any form, in situations where the structure is not pressurized to its full operating load, and thus the connecting plates 150 do not lie completely flush with panels 100, sealing elements 154 can fill any gaps that develop. In addition, maintaining the seals and/or repairing leaks can be relatively easily achieved by repairing sealing elements.

In addition, one or more additional O-rings, bushings, sealing layers (e.g., a rubber seal), or other elements can be provided around and/or between one or more of panels 100, connecting plate 150, and/or fasteners 152 to further prevent undesirable losses of pressure within pressure chamber 200.

Figure 12:
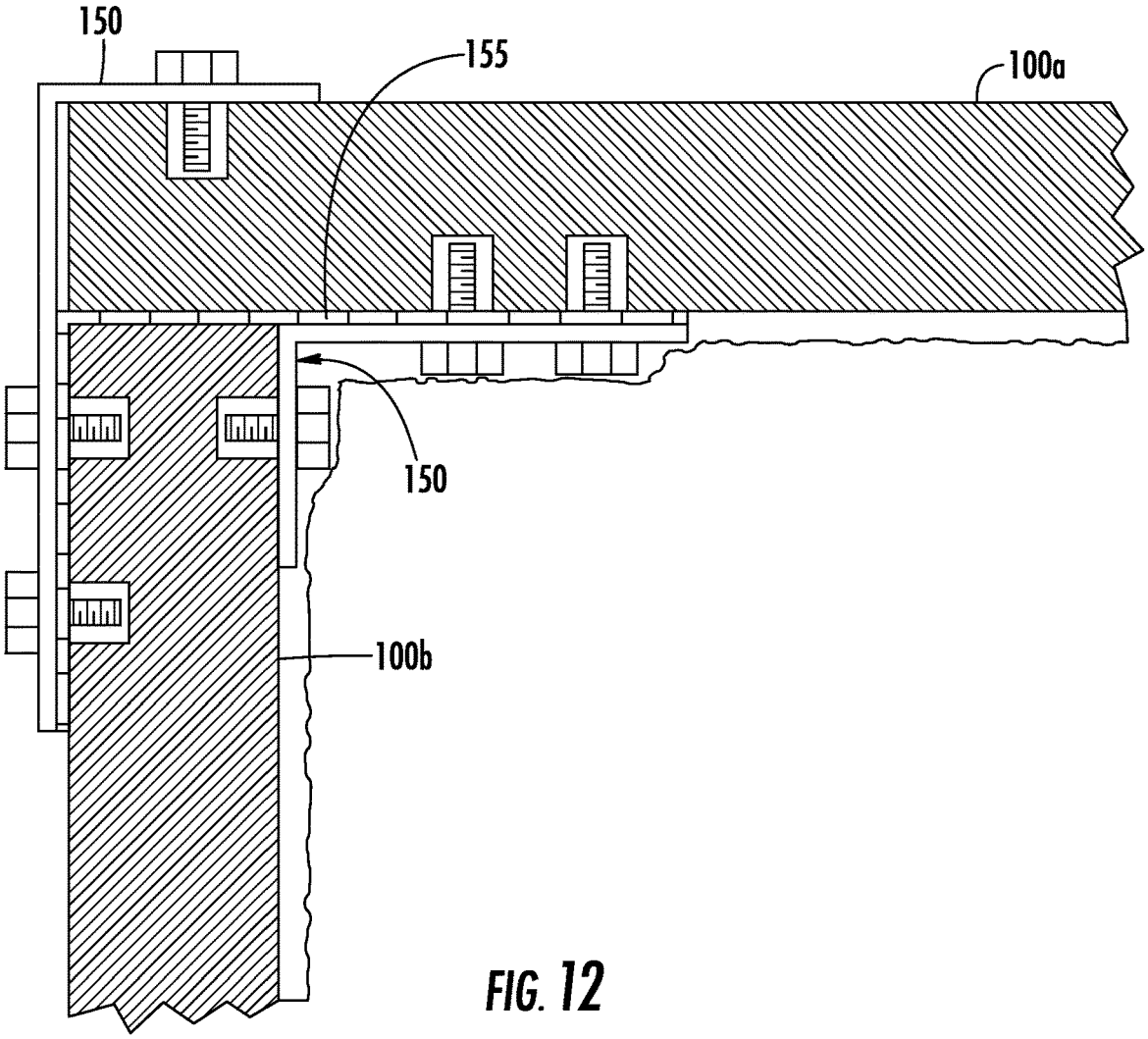
FIGS. 12 and 13 are side cutaway views of connection plate assemblies for use in joining substantially rigid panels in a pressure chamber according to embodiments of the presently disclosed subject matter.
Figure 13:
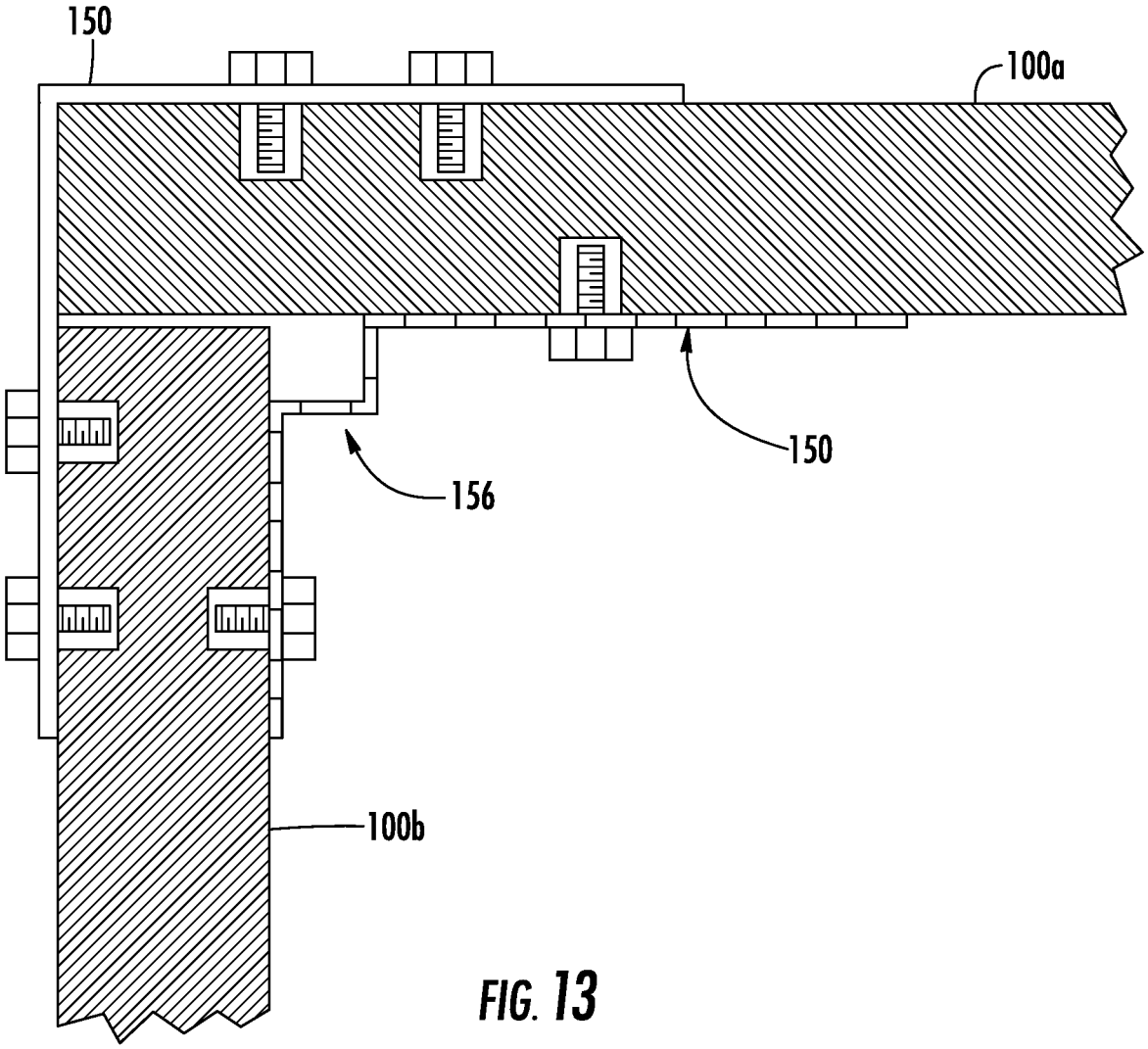

In some embodiments, corner attachments (e.g., at floors, ceilings, and between walls) can include similar structures to those used to seal seams between planar abutting panels 100. Specifically, for example, as illustrated in FIGS. 12 and 13, one or more connecting plate 150 can be used at an interface between a first panel **100*a* and a second panel 100*b* that are coupled in a non-planar arrangement (e.g., at right angles) with respect to one another. Of course, at an angled interface such as a corner, floor, or ceiling connection, connecting plate 150 can be shaped to have an angled profile that follows the outline of the structure as shown in FIGS. 12 and 13. (e.g., a substantially L-shaped profile at a right-angle interface) In addition, in some embodiments, connecting plate 150 can include a flexible joint 156 at or near the interface between first panel 100*a* and second panel 100*b* that can allow for relative movement (e.g., change in interface angle upon pressurization of the structure) between first and second panels 100*a* and 100*b***.

Alternatively or in addition, such joints can further include an interior plate 155 that wraps from an interior surface of a first panel 100*a* around the edge and far enough past the end of first panel 100*a* to connect to an exterior surface of an adjacent second panel 100*b* (see, e.g., FIG. 12). In such an embodiment, interior plate 155 can be an extension of a sheet element 130 associated with one of first panel 100*a* or second panel 100*b*. Alternatively, interior plate 155 can be a separate connecting plate that is independent from the structure of either of first panel 100*a* or second panel 100*b*.

Regardless of the particular components and/or mechanisms that are used to couple the plurality of panels 100 together, panels 100 can be coupled and arranged to define pressure chamber 200 as discussed above, where a pressure differential generator 250 (see FIG. 17) is in communication with the interior of pressure chamber 200 and is configured to control pressure within pressure chamber 200 to be different than an atmospheric pressure outside of pressure chamber 200. Those having ordinary skill in the art will recognize that pressure differential generator 250 can be provided as any of a variety of systems known to modify the pressure within a volume, such as a controllable pump assembly rated to achieve the desired pressure differential between the internal pressure within pressure chamber 200 and an atmospheric pressure outside pressure chamber 200.

In this regard, the modular configuration of panels 100 disclosed herein can be adapted to create pressure chambers 200 having any of a variety of shapes, sizes, and configurations. In configurations of pressure chamber 200 for hypobaric applications, a typical building frame supporting system can be generally used. When used for hyperbaric pressure applications, however, a further consideration in the construction of pressure chamber 200 having a large size compared to conventional hypobaric structures is that the pressure loads must be accounted for in addition to general structural loads.

Figure 14:
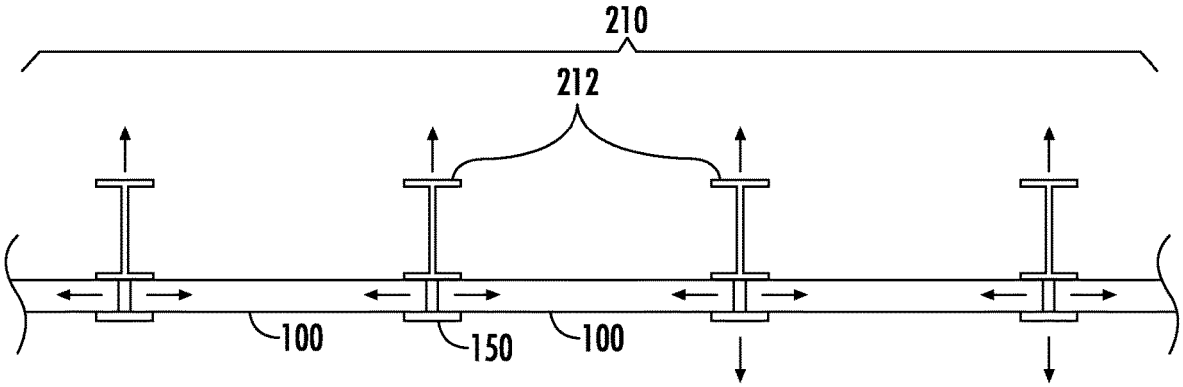
FIGS. 14 and 15 are top views of arrangements of structural beams of a support structure for a pressure chamber according to embodiments of the presently disclosed subject matter.
Figure 16:
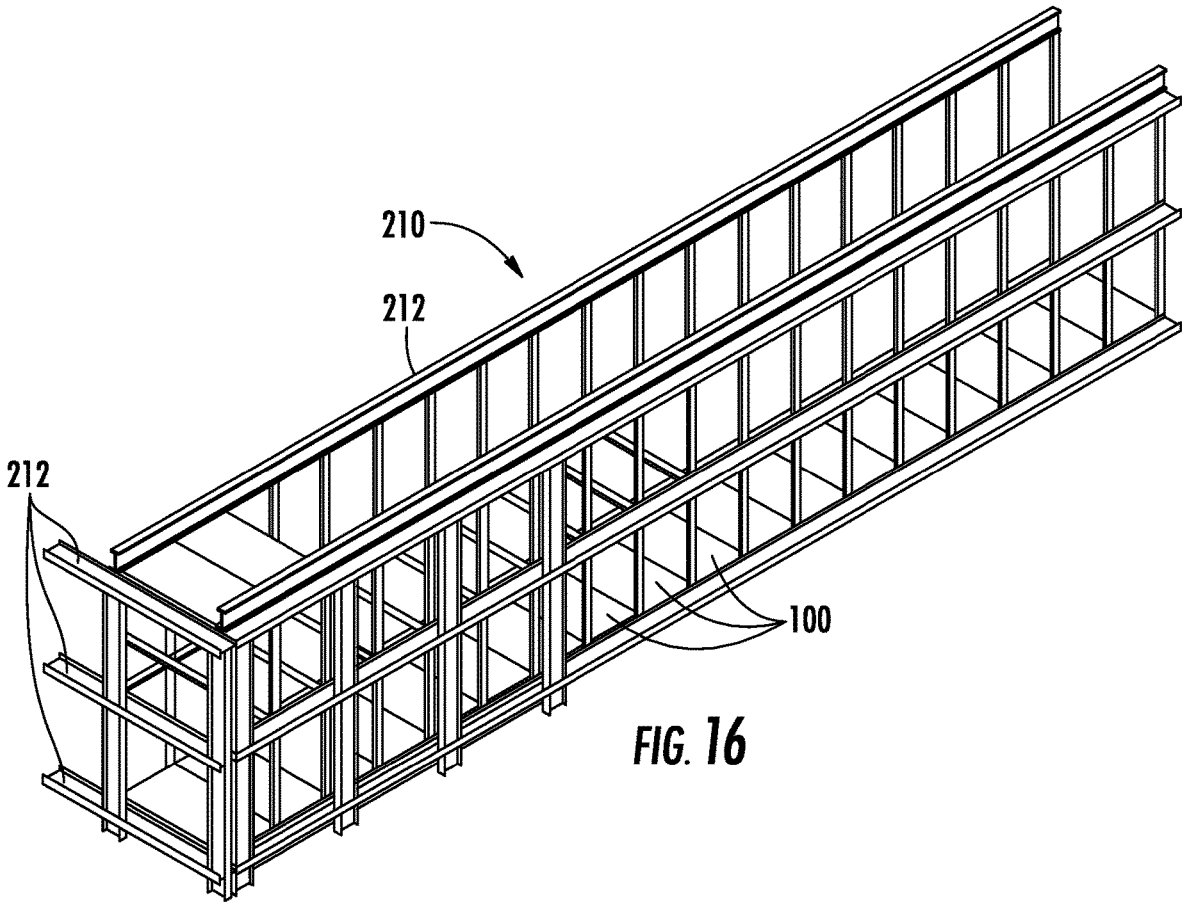
FIG. 16 is a side perspective view of a support structure for a pressure chamber according to an embodiment of the presently disclosed subject matter.

Accordingly, in some embodiments, rather than designing the plurality of panels 100 to handle such a combination of loading conditions, pressure chamber 200 in a hyperbaric pressure configuration can be designed such that the building structural loads are supported by a separate building supporting structure 210. In such a configuration, panels 100 on the exterior of pressure chamber 200 can be specifically configured to support only the pressure loads caused by hyperbaric operating pressures. In some embodiments, to account for the structural frame required to support many times the loads associated with conventional building design, panels 100 can be arranged to bear on supporting structure 210. As shown in FIGS. 14 and 16, for example, the array of substantially rigid panels 100 can be secured to supporting structure 210. In this configuration, panels 100 that make up pressure chamber 200 need not be designed to support the full structural load of the building.

Figure 15:
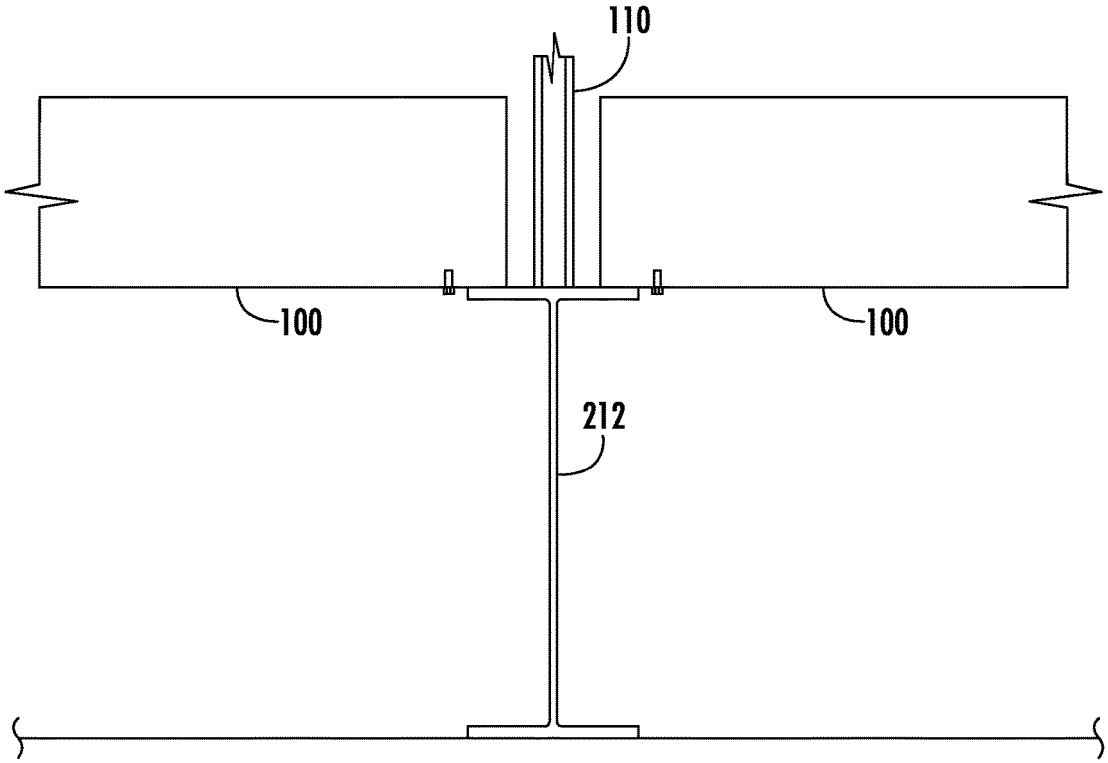

Particularly, referring to FIG. 14, for example, panels 100 can be connected to one another at a structural beam 212 at predetermined distances (e.g., about every 6 feet) to both couple panels 100 together and support the pressure loads on pressure chamber 200. In this way, structural beam 212 can provide a coupling function substantially similar to connecting plate 150 discussed above. Alternatively or in addition, connecting plate 150 can be provided in addition to structural beam 212 at the interface between adjacent panels 100. In some embodiments, one of beam elements 110 can be further positioned between panels 100 at the connection to structural beam 212 (See, e.g., FIG. 15), which can help to support the high structural loads, provide access to seals between panels 100 (e.g., for maintenance or repair), and help ensure tight alignment of panels 100 at their edges. In contrast to conventional building construction, tight tolerances in the alignment and connection of panels 100 can be desirable to help maintain the pressure seal of pressure chamber 200. In this regard, designing support structure 210 to support structural loads independently from the connecting of panels 100 allows these tight tolerances to be achieved without unduly burdening the construction of the structural frame.

Figure 17:
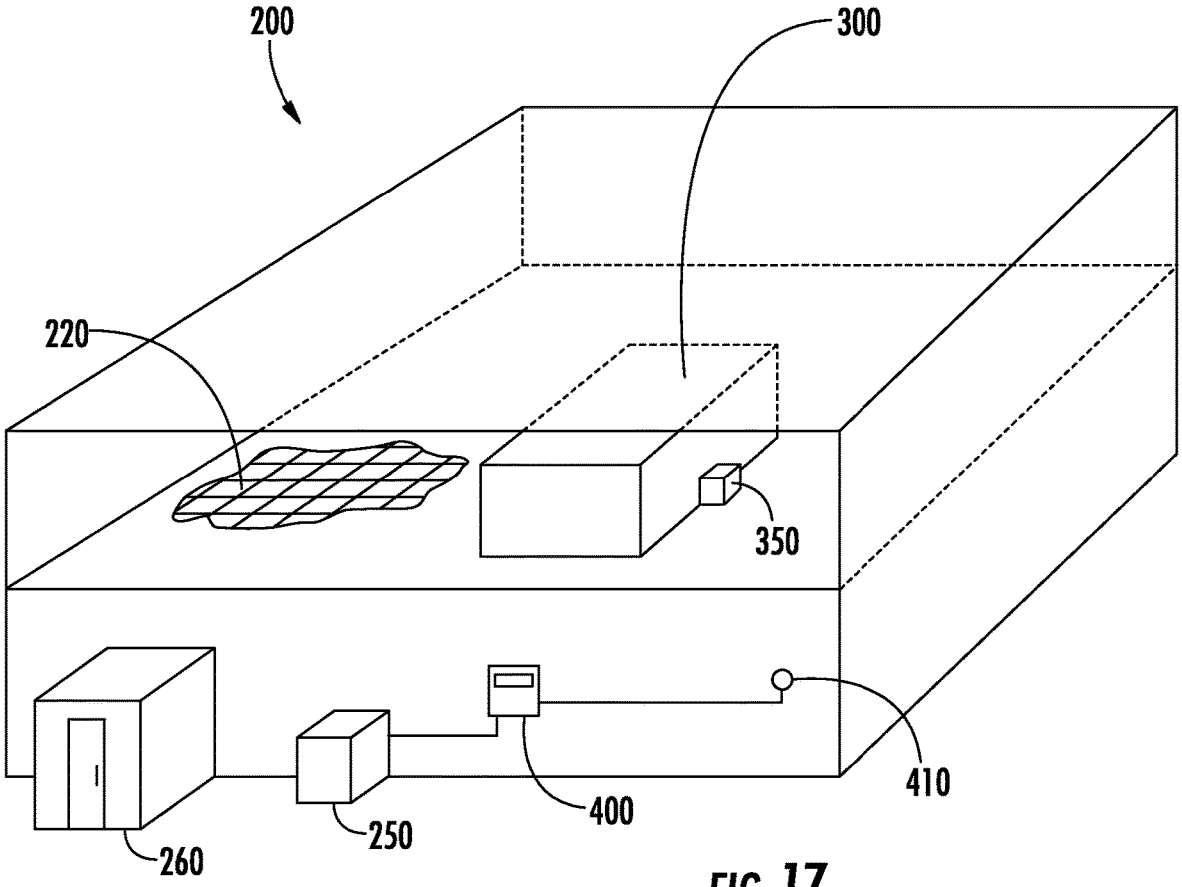
FIG. 17 is a side perspective view of a pressure chamber according to an embodiment of the presently disclosed subject matter.

Furthermore, in some embodiments such as those shown in FIGS. 16 and 17, pressure chamber 200 can be configured as a multi-story structure. In such a configuration, the volume of space contained within the pressurized environment can be expanded without an equivalent expansion in the number of panels 100 and connection elements. Such efficiencies in the use of materials can enable the construction and operating costs of pressure chamber 200 to be reduced compared to conventional configurations.

Of course, expanding the size of pressure chamber 200 in this way can also raise other considerations related to pressurizing such a large space. For example, extending the exterior walls upward to encapsulate a multi-story space can result in greater deflection of the center portion of those of panels 100 that serve as the walls of pressure chamber 200. In some configurations, these panels 100 can be configured to be even stronger and/or stiffer to withstand this increased deflection, and/or support structure 210 can be reinforced to brace against at least some of the increased deflection. Alternatively or in addition, as shown in FIG. 17, one or more tension elements 220 (e.g., cables) can be connected across the space between a subset of the plurality of substantially rigid panels 100. Specifically, tension elements 220 can be connected between wall panels at or about the division between floors in the multi-story structure. In this way, tension elements 220 limit the effect of the pressurized space on the otherwise unsupported span between upper and lower ends of the wall panels.

Alternatively or in addition, the modular nature of the presently-disclosed systems and methods can allow further customization of both the structural configuration and the operation of pressure chamber 200. In particular, for example, the operating parameters of pressure chamber 200 according to the presently disclosed subject matter can in some configurations be limited by a maximum pressure differential that can be supported by panels 100 and associated connecting elements. Where pressures are desired that would exceed the maximum differential recommended relative to atmospheric pressure, the present systems and methods allow for a pressure chamber to be large enough that one or more sub-chambers can be positioned within. As shown in FIG. 17, for example, an inner chamber 300 can be provided entirely within pressure chamber 200, and thus whereas pressure chamber 200 can only be safely pressurized to a first pressure based on the defined maximum pressure differential, inner chamber 300 can further be isolated and pressurized (e.g., using an inner chamber pressure generator 350) above this level to a second pressure that is greater than the first pressure. As an example, if the maximum differential that can be supported by the pressure chamber is about 3 ATM, the first pressure can thus be raised to about 3 ATM, but a further 3 ATM differential between inner chamber 300 and the rest of pressure chamber 200 can raise the second pressure to up to about 6 ATM.

In any configuration, a building health monitoring system 400 can be integrated into pressure chamber 200 to monitor the deflection of panels 100, measure stress in the chamber's structural elements, identify pressure leaks, and/or otherwise monitor the integrity of the structure and its operability as a pressure vessel. Specifically, for example, an array of strain and/or displacement gauges 410 can be placed throughout the structure, such as at locations where levels are designed to be at maximums. These gauges 410 can provide real-time monitoring of the loads experienced at the identified points throughout pressure chamber 200. In addition, one or more numerical models can be generated for the structure to predict failure mechanisms throughout the structure and specifically at the locations of gauges 410. In this way, building health monitoring system 400 can operate based on feedback from the data collected as the structure is loaded.

Figure 18:
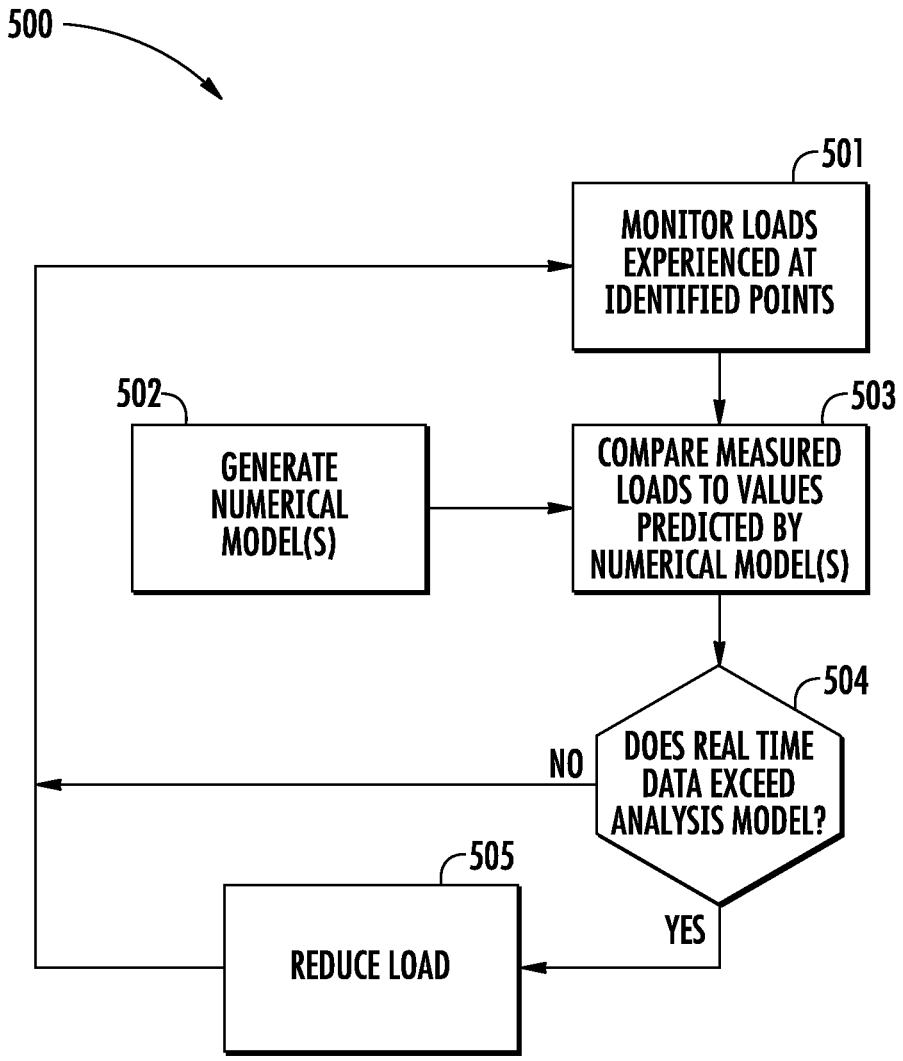
FIG. 18 is a flow chart illustrating a method for monitoring building health of a pressure chamber according to an embodiment of the presently disclosed subject matter.

As illustrated in FIG. 18, for example, a building health monitoring method 500 can involve a data collection step 501 in which loads experienced at identified points can be monitored (e.g., using gauges such as those discussed above). In a modeling step 502, expected values for the loads at the identified points can be calculated in one or more models designed to measure the performance of the structure. In some embodiments, these expected values can be calculated in advance by the one or more models and saved in a lookup table. In other embodiments, expected values can be calculated in real time based on known relationships between system parameters and expected loads. (e.g., by applying a finite element model or applied element method analysis) Regardless of the way in which the expected loads are identified, the measured loads can be compared to these values predicted by the one or more models in a comparison step 503. Based on the output of comparison step 503, a load change decision 504 can be triggered. When real time data exceeds the numerical analysis model, the system can respond by reducing the load in a regulation step 505. For example, in the case of the hyperbaric structure, pressure can be reduced when structural performance is less then expected. Similarly, in the case of the hypobaric structure, vacuum can be reduced when structural performance is less then expected. If the data shows that the values are within the limits of the numerical model, however, pressures can be regulated as needed to achieve the desired internal pressures without imposing a limit from the monitoring system. In this way, the building health monitoring system can anticipate failure of the structural elements and prevent catastrophic blow-out caused by a ruptured pressure seal. Thus, in the event that damage to one of the structural elements is identified or a pressure seal begins to fail, the building health monitoring system can communicate with a control system to initiate a controlled pressure equalization (e.g., depressurization in the case of a hyperbaric configuration).

Furthermore, a door locking system can be likewise integrated with the building health monitoring system. Specifically, as with conventional multiplace pressure chambers, entrance or exit from pressure chamber 200 can be through an airlock system 260 (e.g., a double-layer vestibule system), wherein the entire space does not need to be depressurized each time a person needs to enter or exit. In some embodiments, however, in the event of damage or failure identified by building health monitoring system 400, airlock system 260 can be controlled to allow quick egress from the structure.

In any configuration, the systems and methods disclosed herein can be used to artificially reproduce pressures different than normal atmospheric pressure. In particular, in some embodiments, the pressure chamber systems and methods disclosed herein can be used to produce a hyperbaric environment for hyperbaric oxygen therapy or other high-pressure applications. Alternatively, the pressure chamber systems and methods can be configured to reduce the pressure within the chamber to be less than atmospheric pressure (i.e., a hypobaric environment), which can be desirable to simulate the effects of high altitude on the human body, in some food packaging and/or storage practices (e.g., cold storage of fruits, vegetables, meats, seafoods, or other perishable goods), low-pressure chemical and/or material processing, or in other low-pressure activities. The particular application of the pressure chamber systems and methods (e.g., for generating hyperbaric or hypobaric conditions) can be factored into the design and construction of the pressure chamber, such as via the orientation of the seals and/or tension-supporting elements to support either outwardly-directed pressures (e.g., hyperbaric environment) or inward-directed pressures (e.g., hypobaric environment). Alternatively, the connection of elements in the pressure chamber can be designed to provide a seal and support forces acting in either direction.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A pressure chamber system configured for treatment of a patient with hyperbaric or hypobaric therapy, the pressure chamber system comprising:

a plurality of substantially rigid panels arranged around a space, each of the plurality of substantially rigid panels comprising a metal frame formed from a plurality of elongated beam elements, wherein each of the plurality of elongated beam elements is formed from a plurality of metal frame elements, wherein each of the plurality of metal frame elements has a substantially C-shaped cross-sectional profile including a web and a pair of flanges that extend from opposing sides of the web in a direction substantially perpendicular to a plane of the web, wherein the pair of flanges of a first of the plurality of metal frame elements is joined to the pair of flanges of a second of the plurality of metal frame elements to form each of the plurality of elongated beam elements;

one or more connecting plate coupled to adjacent pairs of the plurality of substantially rigid panels; and a pressure differential generator configured to control pressure within the space to be different than an atmospheric pressure outside of the space;

wherein the one or more connecting plate is configured to provide a pressure-tight seal between a respective one of the adjacent pairs of the plurality of substantially rigid panels.

2. The pressure chamber system of claim 1, wherein the metal frame of one or more of the plurality of substantially rigid panels surrounds a core material.

3. The pressure chamber system of claim 2, wherein the core material comprises a polymer core.

4. The pressure chamber system of claim 1, wherein the plurality of elongated beam elements are connected together in a stacked array.

5. The pressure chamber system of claim 1, wherein the plurality of metal frame elements comprises a plurality of roll-formed steel frame elements.

6. The pressure chamber system of claim 5, wherein at least one of the plurality of roll-formed steel frame elements comprises the substantially C-shaped beam element having a double lip structure at edges of the C-shaped beam element, wherein the first of the plurality of frame elements and the second of the plurality of frame elements are joined by coupling the double lip structure of the first of the plurality of frame elements together with the double lip structure of the second of the plurality of frame elements.

7. The pressure chamber system of claim 1, wherein the plurality of substantially rigid panels, the one or more connecting plate, or all of the plurality of substantially rigid panels and the one or more connecting plate is shaped to maintain a sealing relationship between respective ones of the plurality of substantially rigid panels and the one or more connecting plate upon deflection of the plurality of substantially rigid panels under pressurization of the space.

8. The pressure chamber system of claim 7, wherein the one or more connecting plate is tapered at its edges such that the one or more connecting plate lies substantially flush with coupled edges of the adjacent pairs of the plurality of substantially rigid panels upon deflection of the substantially rigid panels.

9. The pressure chamber system of claim 1, wherein the one or more connecting plate comprises:

a first connecting plate coupled to a first surface of a respective adjacent pair of the plurality of substantially rigid panels; and a second connecting plate coupled to a second surface of the respective adjacent pair of the plurality of substantially rigid panels substantially opposing the first surface.

10. The pressure chamber system of claim 9, comprising one or more coupling elements configured for coupling the first connecting plate and the second connecting plate to the respective adjacent pair of the plurality of substantially rigid panels, wherein the one or more coupling elements comprises:

a coupling member configured for positioning within each of the plurality of substantially rigid panels, the coupling member having a first end and an opposing second end;

a first fastener configured to be received in the first end of the coupling member, the first fastener being configured to couple the first connecting plate to the first surface of one of the respective adjacent pair of the plurality of substantially rigid panels; and a second fastener configured to be received in the second end of the coupling member, the second fastener being configured to couple the second connecting plate to the second surface of the one of the respective adjacent pair of the plurality of substantially rigid panels.

11. The pressure chamber system of claim 10, wherein the coupling member comprises:

a first threaded opening at the first end configured for receiving the first fastener, wherein the first fastener comprises a threaded end;

a second threaded opening at the second end configured for receiving the second fastener, wherein the second fastener comprises a threaded end; and a pressure-tight barrier within the coupling member between the first threaded opening and the second threaded opening.

12. The pressure chamber system of claim 1, comprising one or more tension elements connected across the space between a subset of the plurality of substantially rigid panels.

13. The pressure chamber system of claim 1, comprising one or more elastomeric sealing elements positioned between the one or more connecting plate and each of the respective adjacent pair of the plurality of substantially rigid panels.

14. The pressure chamber system of claim 1, comprising a structural building frame to which the plurality of substantially rigid panels are connected around the space;

wherein the structural building frame is configured to support structural loads of the pressure chamber system; and wherein the plurality of substantially rigid panels are configured to support pressure loads acting on the pressure chamber system.

15. An assembly of substantially rigid panels fora pressure chamber system configured for treatment of a patient with hyperbaric or hypobaric therapy, the assembly comprising:

a plurality of substantially rigid panels arranged around a space, each of the plurality of substantially rigid panels comprising a plurality of elongated beam elements, wherein each of the plurality of elongated beam elements is formed from a plurality of metal frame elements, wherein each of the plurality of metal frame elements has a substantially C-shaped cross-sectional profile including a web and a pair of flanges that extend from opposing sides of the web in a direction substantially perpendicular to a plane of the web, wherein the pair of flanges of a first of the plurality of metal frame elements is joined to the pair of flanges of a second of the plurality of metal frame elements to form each of the plurality of elongated beam elements; and one or more connecting plate coupled to adjacent pairs of the plurality of substantially rigid panels;

wherein the one or more connecting plate is configured to provide a pressure-tight seal between a respective one of the adjacent pairs of the plurality of substantially rigid panels.

16. The assembly of claim 15, wherein the metal frame of one or more of the plurality of substantially rigid panels surrounds a core material.

17. The assembly of claim 15, wherein the plurality of elongated beam elements are connected together in a stacked array.

18. The assembly of claim 15, wherein the plurality of metal frame elements comprises a plurality of roll-formed steel frame elements.

19. The assembly of claim 18, wherein at least one of the plurality of roll-formed steel frame elements comprises the substantially C-shaped beam element having a double lip structure at its edges, wherein the first of the plurality of frame elements and the second of the plurality of frame elements are joined by coupling the double lip structure of the first of the plurality of frame elements together with the double lip structure of the second of the plurality of frame elements.

20. A method of constructing a pressure chamber system configured for treatment of a patient with hyperbaric or hypobaric therapy, the method comprising:

forming a plurality of substantially rigid panels, each of the plurality of substantially rigid panels comprising a metal frame formed from a plurality of beam elements, wherein each of the plurality of elongated beam elements is formed from a plurality of metal frame elements, wherein each of the plurality of metal frame elements has a substantially C-shaped cross-sectional profile including a web and a pair of flanges that extend from opposing sides of the web in a direction substantially perpendicular to a plane of the web, wherein the pair of flanges of a first of the plurality of metal frame elements is joined to the pair of flanges of a second of the plurality of metal frame elements to form each of the plurality of elongated beam elements;

arranging the plurality of substantially rigid panels around a space;

coupling adjacent pairs of the plurality of substantially rigid panels using one or more connecting plate, wherein the one or more connecting plate is configured to provide a pressure-tight seal between a respective adjacent pair of the plurality of substantially rigid panels; and connecting a pressure differential generator in communication with the space to control pressure within the space to be different than an atmospheric pressure outside of the space.

21. The method of claim 20, wherein forming a plurality of rigid panels comprises:

connecting the elongated beam elements in a stacked array to form each of the plurality of substantially rigid panels.

22. The method of claim 20, wherein the plurality of metal frame elements comprises a plurality of roll-formed steel frame elements.

23. The method of claim 20, wherein the metal frame of one or more of the plurality of substantially rigid panels surrounds a core material.

24. The method of claim 20, wherein the method further comprises connecting a structural building frame to the plurality of substantially rigid panels around the space;

wherein the structural building frame is configured to support structural loads of the pressure chamber; and wherein the plurality of substantially rigid panels are configured to support pressure loads acting on the pressure chamber.

* * * * *